US009205315B2

(12) United States Patent
McNulty

(10) Patent No.: US 9,205,315 B2
(45) Date of Patent: Dec. 8, 2015

(54) LACROSSE STICK WITH TEACHING AID

(71) Applicant: Michael J. McNulty, Rockville Centre, NY (US)

(72) Inventor: Michael J. McNulty, Rockville Centre, NY (US)

( * ) Notice: Subject to any disclaimer, the term of this patent is extended or adjusted under 35 U.S.C. 154(b) by 38 days.

(21) Appl. No.: 14/188,902

(22) Filed: Feb. 25, 2014

(65) Prior Publication Data

US 2015/0238831 A1 Aug. 27, 2015

(51) Int. Cl.
*A63B 59/02* (2006.01)
*A63B 59/00* (2015.01)

(52) U.S. Cl.
CPC ..... *A63B 59/02* (2013.01); *A63B 59/0014* (2013.01); *A63B 2243/005* (2013.01)

(58) Field of Classification Search
USPC ..... 473/505, 512, 513
See application file for complete search history.

(56) References Cited

U.S. PATENT DOCUMENTS

| | | | | |
|---|---|---|---|---|
| 2,780,464 | A * | 2/1957 | Ashley | 473/206 |
| 3,203,697 | A * | 8/1965 | Berzatzy | 473/538 |
| 3,227,455 | A * | 1/1966 | Hulsman | 473/206 |
| 7,972,227 | B2 | 7/2011 | Lamson | |
| 8,016,701 | B2 | 9/2011 | Lamson et al. | |
| 8,152,661 | B2 | 4/2012 | House | |
| 2004/0138012 | A1 * | 7/2004 | Tyler | 473/446 |
| 2005/0064960 | A1 * | 3/2005 | Berghash et al. | 473/446 |
| 2007/0129186 | A1 | 6/2007 | Appleton | |
| 2008/0248899 | A1 * | 10/2008 | Whitten et al. | 473/446 |
| 2012/0122616 | A1 | 5/2012 | DePhillips | |

* cited by examiner

*Primary Examiner* — Gene Kim
*Assistant Examiner* — M Chambers
(74) *Attorney, Agent, or Firm* — Hoffmann & Baron, LLP

(57) ABSTRACT

Provided herein is an improved lacrosse stick with a teaching aid. The lacrosse stick includes an elongate member comprising a shaft with a near end and a far end designed for a user to hold the lacrosse stick. The lacrosse stick further includes a basket for holding a ball, the basket being attached to the far end of the shaft. The shaft further includes a teaching aid positioned near the far end of the shaft. The teaching aid is a curling aid which serves as a physical barrier forcing a hand to engage the shaft in a curling position.

16 Claims, 2 Drawing Sheets

LACROSSE STICK WITH TEACHING AID

BACKGROUND

The present invention relates generally to lacrosse equipment, and more particularly, to a lacrosse stick with a teaching aid, as well as methods of manufacture and use.

Conventional lacrosse sticks include a basket, or head joined to a handle, or shaft. The head includes a frame that forms a region within which a lacrosse ball can be caught, held or shot. A netting structure is joined with the back side of the frame, typically laced through multiple small holes defined by the frame. The netting structure typically forms a pocket within which the ball is held while a player is in possession of the ball, and can be a determinant factor as to the player's ability to catch, retain and shoot the ball.

Lacrosse is an ancient game that originated with the Native Americans in North America, particularly in the northeastern United States and Canada. Traditionally, lacrosse sticks were made of wood, usually hickory or ash, and were one integrated piece of equipment so the shaft was not a separate and replaceable part. These sticks were handcrafted and varied in quality in terms of strength, weight, feel and balance in the player's hands. These wooden handles were susceptible to breakage, were heavy and had inconsistent quality, which proved disadvantageous from both a playability and safety standpoint. Also, because the shafts and the lacrosse stick head were one integrated piece of equipment, if the shaft broke the entire stick had to be replaced.

In 1967, the molded plastic lacrosse stick head, as described in U.S. Pat. No. 3,507,495, was developed, which greatly revolutionized the sport of lacrosse. The invention allowed lacrosse sticks to be mass produced, as well as manufactured with consistency in terms of quality and consistency in shape. Wood shafts continued to be used, although they were still susceptible to breakage and were too heavy as compared to the new non-wood sticks.

In the 1970s, shafts of metallic construction, as described in U.S. Pat. No. 4,037,841, were developed. These metal shafts, in large measure, replaced the wood lacrosse stick handles, particularly in the men's game. The advantage of such construction was that the metal shafts could be mass produced with uniform quality, strength and weight, and were generally stronger than wood shafts.

Today, lacrosse stick shafts are made from a variety of materials such as aluminum, chrome, aluminum alloy, titanium, Kevlar, scandium, magnesium, and other composite materials, such as graphite loaded plastics, which are described in U.S. Pat. No. 4,739,994, and are lighter and in some cases, stronger, than wood or the first metal shafts. Historically, most improvements to lacrosse stick shafts were directed to the use of new and different materials with minor additional modifications such as knurling or the like as described in U.S. Pat. No. 4,206,918. All handles were very basic in their shape, generally octagonal, elliptical, oval, cylindrical, round or hexagonal or a combination thereof in cross-section and all were straight from end to end.

In lacrosse, the ability to grasp the shaft in a manner and with an ability to handle the ball is critical. It is needed to perform essential activities, such as cradling, scooping, throwing, or shooting the ball. In particular, when cradling the ball, a player needs to grip the shaft such that the outer ends of their fingers are able to roll the shaft into the palm of one's hand. Such a motion is not intuitive, and utilizes muscles not typically relied on in other activities or sports. As such, it is a difficult task to perform by a user, and difficult to teach for a coach.

Typically, manufacturers design handles for sports shafts that require variable hand placement without a grip as it makes the manufacturing process easier. To improve grip, players often use athletic or gauze tape on their shafts in locations that coincide with their hand placement in order to improve stick control, produce faster shots, serve as a tactile cue for hand placement when stick handling, and accommodate their individual playing style and preference.

Much of the attention in improving lacrosse sticks, has focused on improving its grip. U.S. Pat. No. 6,500,079 to Tucker, Sr., for example, teaches a variable hand placement sports equipment shaft or handle, such as a lacrosse stick, that includes a shaft and at least one overlay attached to the shaft at a location of frequent hand placement that contains ribs, grooves, hourglass and conical shapes. The overlays are preferably made of a material that is soft, pliable, deformable and tacky so as to provide the player with a better grip on the handle. Similar overlays are disclosed in U.S. Pat. No. 4,890,355 to Schulten, U.S. Pat. No. 5,482,270 to Smith, and U.S. Pat. No. 5,867,868 to Ward.

Furthermore, other modifications to shafts for improved handling are available in the prior art. For example, U.S. Patent Application Publications 2005/0130759 and 2005/0130773, both to Hayden et al., teach lacrosse sticks with an improved grip and feel due to expanded portions and contoured locations for users' hand(s). An inward tapered portion and expanded portion allegedly assist a player in controlling the shaft, cradling a ball, passing and shooting.

U.S. Pat. No. 2,031,161 to Hamel discloses bulbous portions adapted to more comfortably fit the shape of the human hand and grooves to provide inter-engaging portions into which a hand becomes partially molded. U.S. Design Patent D475,425 S shows a cricket bat with a contoured handle, which may accommodate finger gripping. Other types of contoured shafts are disclosed in U.S. Pat. No. 4,351,528 to Duplin, U.S. Pat. No. 6,752,730 to Brine, Jr. et al., and U.S. Pat. No. 4,206,918 to Lewis, Jr.

Despite the attempts to improve player grip, little attention has been paid to making a lacrosse stick which can help a user curl his or her hands with the lacrosse stick in the hand in order to promote cradling and other activities with the stick. A big impediment to proper instruction of lacrosse is the inability of new users to curl the stick in their hands.

SUMMARY

Provided therefore, herein, is an improved lacrosse stick with a teaching aid. The lacrosse stick includes an elongate member comprising a shaft with a near end and a far end, the shaft being designed for a user to grasp, thereby holding and controlling the lacrosse stick. The lacrosse stick further includes a basket for holding a ball, the basket being attached to the far end of the shaft. The shaft further includes a teaching aid positioned near the far end of the shaft. The teaching aid is a curling/cradling aid which serves as a physical barrier forcing a hand to engage the shaft in a curled position.

In an embodiment, the teaching aid is a radially projecting member extending from the shaft and forming a pocket in which a user's hand may be inserted. In an embodiment, the teaching aid of the lacrosse stick is arc-shaped projection attached to and extending radially from the shaft, the projection including a far edge, and an inner side wall and outer side wall. In an embodiment, the inner side wall of the arc-shaped projection forms a concave surface and recessed pocket with respect to the shaft.

In another embodiment, the teaching aid further includes a base member for attaching the arc-shaped projection to the shaft of the lacrosse stick. In an embodiment, the base member is a cylindrical sleeve attached to the arc-shaped concave projection, such that said sleeve fits over said the shaft of the lacrosse stick. In an embodiment, the teaching aid is slideable along the shaft. In another embodiment, the teaching aid is fixed in position on the shaft.

In another embodiment, the present invention further includes a method of making a lacrosse stick with a teaching aid. The method includes providing an elongate member including a shaft with a near end and a far end, attaching a basket to the far end of the shaft, and attaching a teaching aid positioned near the far end of the shaft; the teaching aid comprising a grip-promoter which serves as a physical barrier forcing a hand to engage the shaft. In another embodiment, the present invention includes making a teaching aid as presently described, and attaching to a previously made lacrosse stick.

In another embodiment, the present invention also includes a method of using a lacrosse stick with a teaching aid. The method includes a person holding a lacrosse stick, the lacrosse stick comprising an elongate member comprising a shaft with a near end, and a basket for holding a ball attached to the far end of the shaft, the shaft further including a teaching aid positioned near the far end of the shaft; the teaching aid comprising a curling aid which serves as a physical barrier forcing a hand of the user to engage the shaft in a curled position.

In another embodiment, the present invention includes a method of adding a teaching aid to a lacrosse stick, the method including providing a teaching aid with a radially projecting arc-shaped member attached to a base member, and attaching the base member to the lacrosse stick. In an embodiment, the base member includes a cylindrical sleeve attached to the arc-shaped projection, such that said the sleeve fits around a portion of a shaft of the lacrosse stick.

For a better understanding of the present invention, together with other and further objects and advantages, reference is made to the following detailed description, taken in conjunction with the accompanying examples, and the scope of the invention will be pointed out in the appended claims. The following detailed description is not intended to restrict the scope of the invention by the advantages wet forth above.

DETAILED DESCRIPTION

Cradling is a fundamental skill needed in lacrosse. In order to cradle, one typically puts their dominant hand on the lacrosse staff near the head of the stick, or the basket. This is the hand which will control the stick. In order to hold the stick, a user's hands must curl around the shaft of the stick, conforming to the cylindrical shaft. The stick is typically held at a 45 to 60 degree angle with respect to the ground. The curling of the hand around the shaft is also important for other essential tasks of lacrosse, such as picking up ground balls, throwing passes, catching passes, shooting, performing different types of stick checks and most importantly cradling.

Figure 1:
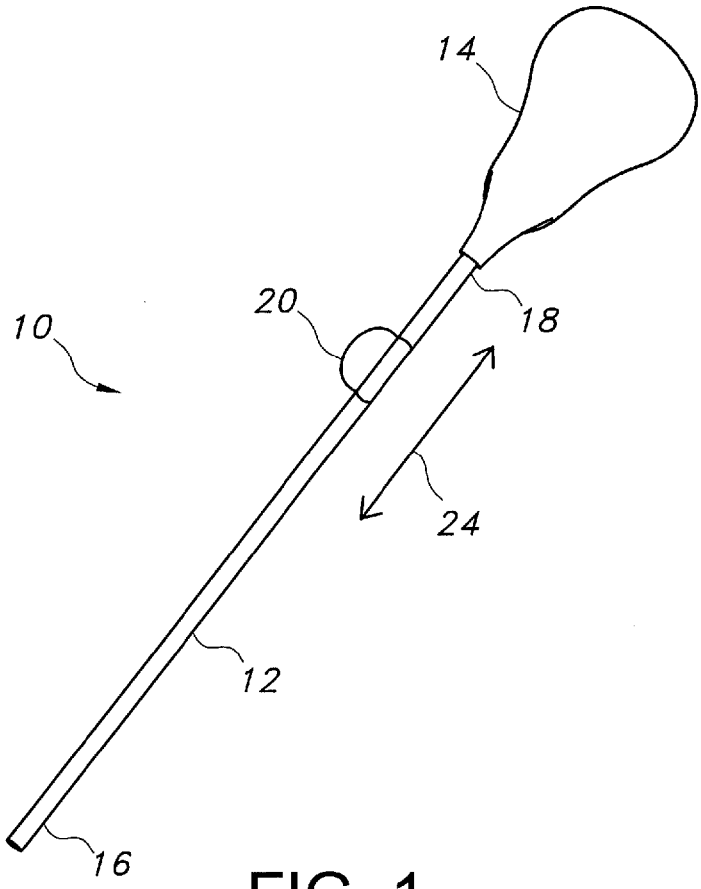
FIG. 1 is a schematic illustration of a lacrosse stick of the present invention.
Figure 2:
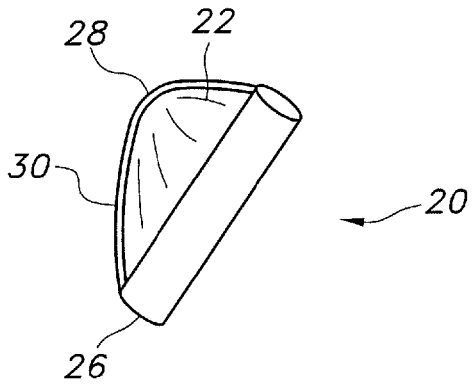
FIG. 2 is a schematic of the teaching aid of the lacrosse stick.
Figure 3:
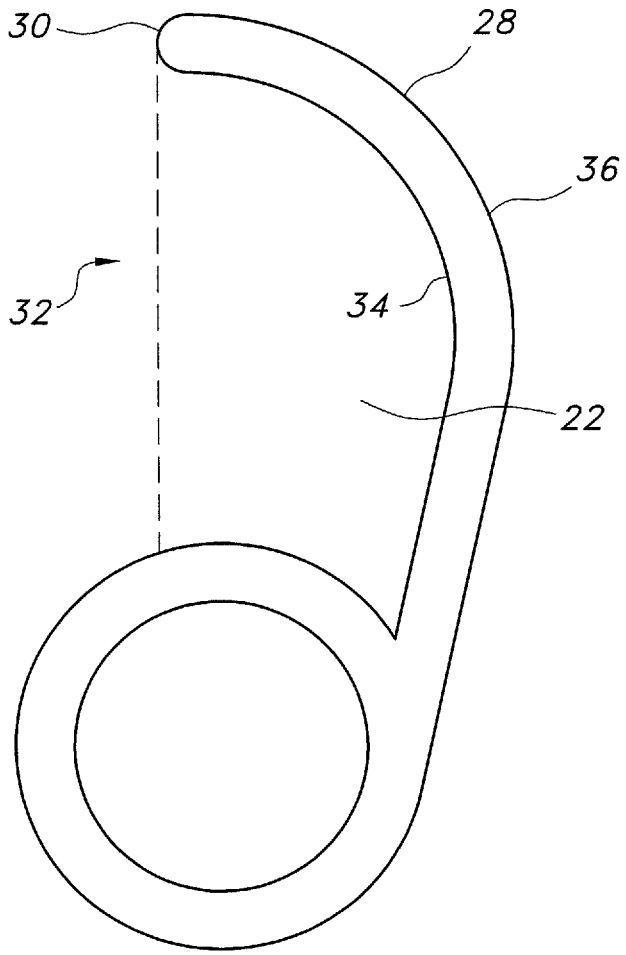
FIG. 3 is a cross-sectional view of the teaching aid of the lacrosse stick of the present invention.

The invention will now be described with reference to FIGS. 1-3. The lacrosse stick of the present invention may be made of any material, including metal, plastic, wood, graphite, etc. FIGS. 1-3 illustrate various embodiments of the invention with respect to a lacrosse stick 10 that comprises a shaft 12 connected to a basket 14, also known as the head of the lacrosse stick. Basket 14 is illustrated for orientation, though details of basket 14 are omitted for simplicity. Shaft 12 includes a near end 16 and a far end 18, so called for the positional relation to a user of the lacrosse stick.

Lacrosse stick 10 further includes a teaching aid 20 positioned near the far end of the lacrosse stick, also shown apart from the lacrosse stick in FIG. 2. The teaching aid is essentially an arc-shaped projection 28 extending radially outwardly from an outer surface of a portion of the stick. The projection 28 includes a concave surface which forms a pocket portion 22 in which a hand will be inserted, and which will promote a curled position of the hand on the shaft.

With further reference to FIG. 3 of the drawing, arc-shaped projection 28 includes an inner side wall 34 and outer side wall 36, and also includes a far edge 30 which defines a plane 32, also extending radially from shaft 12. Concave pocket 22 includes the space extending from plane 32 to the inner side wall 34, and allows insertion of a hand therein. It may be appreciated that projection 28 is shown as arc-shaped, but is not limited thereto. Projection 28 may be any shape which promotes a curled configuration of a user's hand thereby allowing performance of the basic lacrosse skills.

The present invention applies equally to any type of shaft or teaching aid material—whether wood, aluminum, chrome, aluminum alloy, titanium, Kevlar, scandium, magnesium, and carbon graphite, plastic and other composite materials, or spiral wound laminated wood ("wound wood") as described in U.S. patent application Ser. No. 10/867,541 to Botten et al., which is herein incorporated by reference.

Teaching aid 20 is positioned on shaft 12 proximal to far end 18 of the shaft, in such position where a user holds lacrosse stick 10. Teaching aid may be fixed in its position on shaft 12, or it may be slidably movable along shaft 12, corresponding to directional arrow 24. This movement corresponds to the different hand locations a lacrosse player may place his or her hands on a lacrosse stick when performing different tasks; e.g., catching, throwing, and cradling of the ball.

Teaching aid 20 can be used with a lacrosse stick designed for male or females. In an embodiment, teaching aid 20 includes a base member 26 for attaching the arc-shaped member to the shaft. As shown here, the base member is a cylindrical sleeve 26 having an inner diameter sized to fit snugly over shaft 12. The cylindrical sleeve 26 further includes an arc-shaped concave attachment 28 projecting radially outwardly therefrom. Concave attachment 22 is shaped to fit a hand therein, and promotes a curling con—ration of said hand there within. The curling position of the hand enables a user to more easily perform a cradling action with a lacrosse stick and ball, thus simplyfing the teaching process.

In another embodiment, a lacrosse stick may have a second teaching aid appended thereto, thus enabling both hands to more effectively curl around shaft 12. Teaching aid 20 can be attached to shaft 12 by any means, including, use of an adhesive, welding, clamping, separate attachment means, or by simply creating a snug fit which ensures attachment thereto. Additionally, and as mentioned above, teaching aid 20 may be movably fixed on shaft 12 so that it may slide along shaft 12 with a user's hand. This may also be accomplished by any means possible, as known in the art.

In another embodiment, a teaching aid comprising a simple strap attached to a lacrosse stick may be used in order to further help a new lacrosse player. The strap can be a simple rubber or plastic strip attached to the lacrosse stick at either end of the strip, and into which a user's hand may be inserted. This embodiment would work by a different mechanism than the arc-shaped teaching aid since it would only promote a user to hold the lacrosse stick, and would not promote a curling engagement by the hand, which thusly aids in the cradling action by the user.

EXAMPLES

In order to make and test a lacrosse stick of the present invention, a curved arc-shaped metal piece was procured, and attached to a shaft of a standard lacrosse stick at the proper location, i.e., where the player typically holds the stick. A young person, approximately 4 years old, then tested the lacrosse stick to see if it would help the subject curl the stick, i.e., roll the stick from a fingertip grip toward the palm. The subject was successful, and was able to cradle the stick correctly. The same person was not able to do before using the device.

After the prototype was successfully made and tested, we created a metal sleeve with an arc-shaped concave attachment. The metal sleeve served as the base member which would fit over/around the shaft and would give the user the ability to draw the stick from the tip of the fingers toward the palm of the hand to perform the proper cradling motion, but could also slide up and down the shaft so that the user can perform the proper motion and have their hands in the correct location(s) on the shaft for scooping and catching as well as for throwing/shooting the lacrosse ball.

Thus while there have been described what are presently believed to be preferred embodiments of the invention, those skilled in the art will realize that changes and modifications may be made thereto without departing from the spirit of the invention, and it is intended to claim all such changes and modifications as fall within the true scope of the invention.

What is claimed is:

1. A lacrosse stick comprising:

an elongate member comprising a shaft with a near end and a far end, said shaft designed for a user to hold said lacrosse stick;

a basket for holding a ball, said basket attached to said far end of said shaft;

said shaft further comprising a teaching aid positioned near said far end of said shaft; said teaching aid comprising a curling aid comprising a radially projecting member extending from said shaft and ending in a far edge which forms a plane which is radially extending from and longitudinally oriented with respect to said shaft, said curling aid further including an inner side wall and outer side wall leading to said far edge and including a recessed pocket with regard to said plane, said inner side wall serves as a physical barrier forcing a hand to engage said shaft in a curled position.

2. The lacrosse stick according to claim 1 wherein said teaching aid comprises an arc-shaped projection attached to and extending radially from said shaft.

3. The lacrosse stick according to claim 2 wherein said teaching aid further comprises a base member for attaching said teaching aid to said shaft.

4. The lacrosse stick according to claim 3 wherein said base member comprises a cylindrical sleeve attached to said arc-shaped projection, such that said sleeve fits around a portion of said shaft of said lacrosse stick.

5. The lacrosse stick according to claim 2 wherein said inner side wall of said arc-shaped projection forms a concave surface and recessed pocket.

6. The lacrosse stick according to claim 1 wherein said teaching aid is slideable along said shaft.

7. The lacrosse stick according to claim 1 wherein said teaching aid is fixed in position on said shaft.

8. The lacrosse stick according to claim 1 wherein said teaching aid includes a pocket in which a user's hand may be inserted.

9. A teaching aid for use with a lacrosse stick comprising a curling aid serving as a physical barrier forcing a user's hand to engage a shaft of said lacrosse stick in a curled position, said curling aid comprising a radially projecting member extending from said shaft and ending in a far edge which forms a plane which is radially extending from and longitudinally oriented with respect to said shaft, said curling aid further including an inner side wall and outer side wall leading to said far edge and including a recessed pocket with regard to said plane, said inner side wall, said teaching aid designed for attachment to said shaft.

10. The teaching aid according to claim 9 wherein said teaching aid comprises an arc-shaped projection attached to and extending radially from said shaft, said projection including a far edge, and an inner side wall and outer side wall.

11. The teaching aid according to claim 10 wherein said inner side wall of said arc-shaped projection forms a concave surface and recessed pocket.

12. The teaching aid according to claim 9 wherein said teaching aid comprises a radially projecting member extending from said shaft and forming a pocket in which a user's hand may be inserted.

13. A method of adding a teaching aid to a lacrosse stick comprising:

i) providing a teaching aid as defined in claim 1 with a radially projecting member attached to a base member, and ii) attaching said base member to said lacrosse stick.

14. The method according to claim 13 wherein said base member comprises a cylindrical sleeve attached to said arc-shaped projection, such that said sleeve fits around a portion of a shaft of said lacrosse stick.

15. A method of making a lacrosse stick with a teaching aid comprising providing an elongate member comprising a shaft with a near end and a far end, attaching a basket to said far end of said shaft, and attaching a teaching aid positioned near said far end of said shaft; said teaching aid comprising a curling aid as defined in claim 1 which serves as a physical barrier forcing a hand to engage said shaft.

16. A method of a person using a lacrosse stick with a teaching aid comprising said person holding a lacrosse stick, said lacrosse stick comprising an elongate member comprising a shaft with a near end, and;

a basket for holding a ball attached to said far end of said shaft;

said shaft further comprising a teaching aid as defined in claim 1 positioned near said far end of said shaft; said teaching aid comprising a curling aid which serves as a physical barrier forcing a hand of said person to engage said shaft in a curling position.

* * * * *